US009330556B2

(12) United States Patent
Rennie et al.

(10) Patent No.: US 9,330,556 B2
(45) Date of Patent: May 3, 2016

(54) PNEUMATIC PRESSURE SWITCH

(71) Applicant: Kidde Technologies, Inc., Wilson, NC (US)

(72) Inventors: Paul Rennie, Bracknell (GB); Paul D. Smith, Camberley (GB)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 31 days.

(21) Appl. No.: 14/249,815

(22) Filed: Apr. 10, 2014

(65) Prior Publication Data

US 2014/0320292 A1 Oct. 30, 2014

(30) Foreign Application Priority Data

Apr. 30, 2013 (GB) ..... 1307797.9

(51) Int. Cl.

| | |
|---|---|
| ***G08B 21/00*** | (2006.01) |
| ***G08B 21/18*** | (2006.01) |
| ***G08B 17/04*** | (2006.01) |
| ***F15B 15/20*** | (2006.01) |
| ***H01H 35/26*** | (2006.01) |
| ***H01H 35/34*** | (2006.01) |

(52) U.S. Cl.

CPC ..... *G08B 21/182* (2013.01); *F15B 15/20* (2013.01); *G08B 17/04* (2013.01); *H01H 35/2657* (2013.01); *H01H 35/346* (2013.01)

(58) Field of Classification Search

CPC .... G08B 17/04; G08B 21/182; G08B 29/043; G08B 13/20; F15B 15/20; H01H 35/2657; H01H 35/34; H01H 35/346; H01H 35/2671; H01H 35/26; B60G 17/0155; B60G 17/0523; B60G 2202/314; B60G 2202/412

USPC ..... 340/626, 591–593, 584, 945, 622, 614, 340/635, 655, 643, 657, 3.22

See application file for complete search history.

(56) References Cited

U.S. PATENT DOCUMENTS

| | | | | |
|---|---|---|---|---|
| 1,986,479 | A | 1/1935 | Lowe | |
| 3,122,728 | A | 2/1964 | Lindberg, Jr. | |
| 3,882,439 | A | 5/1975 | Wolfe | |
| 3,896,423 | A * | 7/1975 | Lindberg | 340/508 |
| 4,333,500 | A * | 6/1982 | Broerman | 137/863 |
| 4,373,388 | A * | 2/1983 | Kitamura et al. | 73/301 |

(Continued)

FOREIGN PATENT DOCUMENTS

| | | |
|---|---|---|
| DE | 2529733 A1 | 1/1977 |
| GB | 611950 A | 11/1948 |

OTHER PUBLICATIONS

GB Search Report for Application No. GB1307797.9. Mailed on Sep. 25, 2013. 6 Pages.

EP Search Report for Application No. 14161029.5 Mailed on Jul. 13, 2015. 7 Pages.

GB Search Report for Application No. GB1307797.9. Mailed on Jun. 24, 2014. 2 Pages.

(Continued)

*Primary Examiner* — Daniel Previl

(74) *Attorney, Agent, or Firm* — Cantor Colburn LLP

(57) ABSTRACT

A pneumatic pressure detector comprises a first electrical terminal, a second electrical terminal and a deformable diaphragm configured to deform between first, second and third positions. When the diaphragm is in its first position, the first and second terminals are open. When the diaphragm is in its second position, the first terminal is open and the second terminal is closed. When the diaphragm is in its third position, the first and second terminals are both closed. The pneumatic pressure detector may be connected to a sensor tube.

14 Claims, 2 Drawing Sheets

(56) References Cited

U.S. PATENT DOCUMENTS

| | | | | |
|---|---|---|---|---|
| 4,975,679 | A | 12/1990 | Ballyns | |
| 5,136,278 | A * | 8/1992 | Watson et al. | 340/592 |
| 5,526,692 | A * | 6/1996 | Keiser | 73/715 |
| 5,691,702 | A * | 11/1997 | Hay | 340/626 |
| 6,639,165 | B1 | 10/2003 | Newman | |
| 2009/0236205 | A1 * | 9/2009 | Nalla et al. | 200/81.4 |

OTHER PUBLICATIONS

Notification of Transmittal of the International Search Report and the Written Opinion of the International Searching Authority, or the Declaration; Application 14184634.5; Feb. 17, 2015, 6 pages.
EP Search Report for Application No. 14161029.5 Mailed on Feb. 1, 2016. 13 Pages.

* cited by examiner

PNEUMATIC PRESSURE SWITCH

CROSS REFERENCE TO RELATED APPLICATIONS

This application claims priority to GB Patent Application No. 1307797.9 filed Apr. 30, 2013, the entire contents of which is incorporated herein by reference.

TECHNICAL FIELD

The present disclosure relates to a deformable diaphragm for use in a pneumatic pressure detector, a pneumatic pressure detector comprising a diaphragm and an overheat or fire alarm system comprising a pneumatic pressure detector. Such overheat or fire alarm systems can be used to monitor a number of different environments including various parts of aircraft or other aerospace applications.

BACKGROUND

A known overheat or fire alarm system comprises a sensor tube in fluid communication with a pneumatic pressure detector, also known as a pressure switch module. The sensor tube commonly comprises a metallic sensor tube containing a metal hydride core, typically titanium hydride, and an inert gas fill, such as helium. Such a system is shown in U.S. Pat. No. 3,122,728 (Lindberg).

Exposure of the sensor tube to a high temperature causes the metal hydride core to evolve hydrogen. The associated pressure rise in the sensor tube causes a normally open pressure switch in the detector to close. This generates a discrete fire alarm. The pneumatic pressure detector is also configured to generate an averaging overheat alarm due to the pressure rise associated with thermal expansion of the inert gas fill. The discrete and average alarm states may be detected as either a single alarm state using a single pressure switch or separately using at least two pressure switches.

It is also common practice to incorporate an integrity pressure switch that is held closed, in normal temperature conditions, by the pressure exerted by the inert gas fill. A known pneumatic pressure detector having an alarm switch and an integrity switch is shown in U.S. Pat. No. 5,136,278 (Watson et al.). The detector uses an alarm diaphragm and an integrity diaphragm having a common axis.

One shortcoming associated with known designs is the relatively large internal free volume of the pneumatic pressure detector. Gas within the free volume of the pneumatic pressure detector will reduce the pressure rise associated with expansion of the inert gas or evolution of hydrogen within the sensor tube. This will have a detrimental effect on the heat detection capabilities of the system. In addition hydrogen gas evolved during a discrete alarm condition may enter the free volume of the pneumatic pressure detector. This hydrogen gas is then no longer in physical contact with the metal hydride core and cannot be reabsorbed upon cooling. This will have a detrimental effect of the ability of the detection system to successfully reset after a discrete alarm event. Both of these effects are more significant for short sensor tube lengths.

The present disclosure seeks to address at least some of these issues.

SUMMARY

There is disclosed herein a pneumatic pressure detector comprising a first electrical terminal, a second electrical terminal and a deformable diaphragm configured to deform between first, second and third positions. When the diaphragm is in its first position, the first and second terminals are open. When the diaphragm is in its second position, the first terminal is open and the second terminal is closed. When the diaphragm is in its third position, the first and second terminals are both closed. The detector is configured such that a first alarm is activated when the first terminal is closed and a second alarm is activated when the second terminal is opened.

The pneumatic pressure detector therefore uses a single deformable diaphragm to open and close two different terminals. The first alarm may constitute a fire or overheat alarm that indicates an increase in pressure in a connected sensor tube. The second alarm may constitute an integrity alarm that indicates a drop in pressure in a connected sensor tube.

The first and second alarms may be in the form of an audible or visible alert, or any other suitable alert. Any suitable means for providing such an alert may be provided. For example, a display may be used to provide a visible alert.

As there is only a single diaphragm, the pneumatic pressure detector may be smaller, lighter and have less internal free volume.

The pneumatic pressure detector may be connected to any available sensor tube, such as that described above.

The deformable diaphragm is configured to be able to move between first, second and third positions within the detector. It should be understood that when moving between different positions, some parts of the diaphragm may not move. As such, when the diaphragm moves between positions, some parts of the diaphragm will move while others may remain stationary. Another way of describing this is that while some parts of the diaphragm may remain stationary between positions, the overall cross-sectional profile or configuration of the diaphragm changes.

The first position of the diaphragm may be an at-rest position, i.e. the position of the diaphragm when only ambient pressure is acting thereon. The diaphragm may move from the first position to the second position when the pressure is increased. The diaphragm may then move from the second position to the third position when the pressure is increased further. A drop in pressure may cause the diaphragm to move from the third position to the second position. A further drop in pressure may cause the diaphragm to move from the second position to the first position.

The diaphragm may comprise or be formed of an electrically conductive material so that contact between the diaphragm and the first terminal closes the first terminal and contact between the diaphragm and the second terminal closes the second terminal. In such an arrangement, in its first position, the diaphragm is not in contact with the first or second terminals. In its second position, the diaphragm is in contact with the first terminal and not in contact with the second terminal. In the third position, the diaphragm is in contact with both the first and second terminals.

Alternatively, the diaphragm may contact the terminals indirectly. For example, the diaphragm could contact actuators (e.g. push-rods) that when contacted cause first and second switches containing the first and second terminals respectively to close.

Any known circuitry may be used to electrically connect the diaphragm and first and second terminals to alarm circuits. Suitable circuitry is shown in U.S. Pat. No. 5,136,278 (Watson) and U.S. Pat. No. 5,691,702 (Hay) and would be apparent to a person skilled in the art.

The first and second terminals may each comprise a single contact or multiple contacts that are electrically connected.

The diaphragm may be located within a housing of the detector.

The housing may have a gas inlet for connection to a sensor tube.

At least a portion or all of the peripheral edge or edges of the diaphragm may be secured to an inner surface or surfaces of the housing.

The diaphragm may be secured to the housing to define first and second plenums within the housing. The first and second plenums may be hermetically isolated from each other. Having only two plenums means that there is less internal free volume within the detector, as compared to a detector having two diaphragms and three separate plenums.

In use, at a first pressure in the first plenum, the diaphragm is in the first position. At a second pressure in the first plenum, the diaphragm is in the second position. At a third pressure in the first plenum, the diaphragm is in the third position. The second pressure is higher than the first pressure and lower than the third pressure.

The first plenum may be in fluid communication with the gas inlet and the second plenum may comprise the first and second terminals. The first and second terminals may either extend into the second plenum or be provided by or on an inner wall of the housing defining the second plenum.

Alternatively, the first and second terminals may be provided outside of the plenum and/or housing and the diaphragm may contact these terminals indirectly using actuators, as discussed above.

The first and/or second terminals may extend within the second plenum towards the diaphragm. The first and/or second terminals may extend from a wall of the housing defining the plenum.

The first and second terminals may both extend towards the diaphragm. The distance between the second terminal and the diaphragm in its first position may be less than that between the first terminal and the diaphragm. As such, when the diaphragm deforms towards the first and second terminals, it will contact the second terminal before the first terminal.

In use, as the pressure in the first plenum increases, the diaphragm may deform from its first position into its second position, with at least a portion of the diaphragm moving towards the second plenum, i.e. towards the first and second terminals. As the pressure in the first plenum increases further, the diaphragm may deform from its second position into its third position, with at least a portion of the diaphragm moving in the direction of the second plenum, i.e. towards the first and second terminals.

The diaphragm may comprise a first portion deformable between first and second configurations and a second portion deformable between first and second configurations. When the diaphragm is in its first position, the first portion and the second portion are both in their first configuration. When the diaphragm is in its second position, the first portion is in its first configuration and the second portion is in its second configuration. When the diaphragm is in its third position, the first portion and the second portion are both in their second configurations.

The first configuration of each portion is a relaxed or undeformed configuration. The second configuration of each portion is a deformed configuration. It should be understood that there may some movement of the first and second portions while in their first configuration without deforming into their second configuration.

In use, as the pressure acting upon the diaphragm increases, the second portion deforms into its second configuration while the first portion remains in its first configuration. This causes the second terminal to be closed. As the pressure is increased further, the first portion then also deforms into its second configuration. This causes the first terminal to be closed and the first alarm (e.g. a fire or overheat alarm) to be activated. If insufficient pressure acts upon the diaphragm, both the first and second portions remain in their first configurations, with the effect that both the first and second terminals are open. In this situation, the second alarm (e.g. an integrity alarm) will be activated.

The second portion may surround the first portion. In other words, the first portion may be an inner portion and the second portion may be an outer portion that extends around the outer perimeter of the first portion.

The second portion may have an annular shape. Alternatively, the second portion may have some other shape that surrounds the first portion.

The first portion may be circular.

The first and second portions may be concentric.

The diaphragm may be substantially circular or circular.

The first portion may be contiguous with the second portion.

If the second portion is annular, the second terminal may also be annular or may comprise a number of points of contact arranged in a circle.

Alternatively, the diaphragm may not have discrete first and second portions and may instead deform as whole from the first position to the second position and then to the third position. The level of deformation of the diaphragm may determine which terminals are closed. For example, when fully deformed into its third position, the first and second terminals will both be closed, but when only partially deformed into its second position, the second terminal will be closed while the first terminal remains open. The first and second terminals may be arranged such that the diaphragm contacts only the second terminal in the second position and contacts both terminals in the third position. In order to achieve this result, the second terminal may be positioned closer to the diaphragm than the first terminal.

The present disclosure also extends to an overheat or fire alarm system comprising the diaphragm described above.

The system may further comprise a sensor tube in fluid communication with the diaphragm, and in particular in fluid communication with the first plenum of the pneumatic pressure detector.

The sensor tube may be as described above in relation to the prior art, namely a metallic (e.g. an Inconel alloy) tube containing a metal hydride core (e.g. titanium hydride) and an inert gas fill (e.g. helium).

In use, at a first pressure in the sensor tube, the diaphragm is in the first position. At a second pressure in the sensor tube, the diaphragm is in the second position. At a third pressure in the sensor tube, the diaphragm is in the third position. The second pressure is higher than the first pressure and lower than the third pressure.

The system may be configured such that the first pressure corresponds to an ambient pressure outside of the tube. This will of course depend on the desired location of the sensor tube, when in use. Once the sensor tube and pneumatic pressure detector have been connected, the first plenum should only be at the first pressure when there is a gas leak in the system.

The second pressure may correspond to a normal operating pressure within the sensor tube, i.e. the pressure of the helium gas fill, under normal operating temperatures. The second pressure will be set according to the desired sensitivity of the detector.

The third pressure may correspond to an increased pressure within the sensor tube due to an overheat state causing an increase in pressure of helium gas fill, or a fire state causing evolution of hydrogen from metal hydride core.

The system may be arranged such that closure of the first terminal provides a fire or overheat alarm and the opening of the second terminal provides an integrity alarm. The integrity alarm indicates low pressure, which may be due to a leak in the system, for example in the sensor tube.

The fire or overheat alarm system may comprise a plurality of pneumatic pressure detectors having any of the features described above. The system may comprise one or more detectors acting as fire alarms and one or more detectors acting as overheat alarms (having a lower sensitivity than the one or more fire alarms). The first terminals of each of the detectors may be connected in parallel so that the first alarm will be activated when any one of the first terminals is closed. The second terminals of each of the detectors may be connected in series so that the second alarm will be activated when any one of the second terminals are opened.

The present disclosure also extends to a diaphragm for a pneumatic pressure detector, the diaphragm comprising a first portion deformable between first and second configurations and a second portion deformable between first and second configurations while the first portion is in said first configuration. The second portion surrounds the first portion.

In other words, the first portion may be an inner portion and the second portion may be an outer portion that extends around the outer perimeter of the first portion.

The second portion may have an annular shape. Alternatively, the second portion may have some other shape that surrounds the first portion.

The first portion may be circular.

The first and second portions may be concentric.

The diaphragm may be substantially circular or circular.

The first portion may be contiguous with the second portion.

The diaphragm may have any of the features of the diaphragm described above in relation to the pneumatic pressure detector.

In use, as the pressure acting upon the diaphragm increases, the second portion deforms into its second configuration while the first portion remains in its first configuration. It should be understood that, as the second portion deforms into its second configuration, there may some movement of the first portion, but not enough so that it deforms into its second configuration.

As the pressure is increased further, the first portion then also deforms into its second configuration. If insufficient pressure acts upon the diaphragm, both the first and second portions remain in their first configurations.

The first configuration of each of the first and second portions can be considered to be an undeformed or relaxed state, while the second configuration can be considered to be a deformed or activated state.

Providing first and second portions that can be independently deformed allows a single diaphragm to deform in stages. In use in a pneumatic pressure detector, this allows different alarm states to be activated at selected pressures.

The present disclosure also extends to a pneumatic pressure detector comprising a diaphragm as described above, wherein the diaphragm is secured to the housing to define first and second plenums within the housing.

The first and second plenums may be hermetically isolated from each other.

Increasing the pressure within said first plenum causes the second portion to deform between first and second configurations and then further increasing the pressure causes the first portion to deform between the first and second configurations.

At least a portion or all of the peripheral edge or edges of the diaphragm may be secured to an inner surface or surfaces of the housing.

The diaphragm according to any of the above described arrangements may be formed of any suitable material. The diaphragm may be formed of a metallic material, such as a metal alloy, such as a TZM alloy. The diaphragm may be formed via mechanical forming, for example using a press die. Alternatively, or additionally, fluid pressure may be used to form the diaphragm into a desired shape. Alternatively, or additionally, wet or dry etching techniques may be used to thin the diaphragm in selected regions to provide the diaphragm with desired properties. The second portion of the diaphragm may be etched to be thinner than the first portion so that it deforms at a lower pressure than the first portion.

The present disclosure also extends to an overheat or fire alarm system comprising a pneumatic pressure detector as described above.

BRIEF DESCRIPTION OF THE DRAWINGS

Some exemplary embodiments of the present disclosure will now be described by way of example only and with reference to FIGS. 1 to 3, of which.

DETAILED DESCRIPTION

Figure 1:
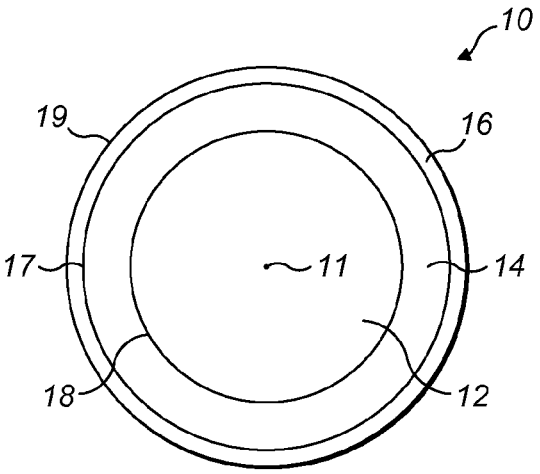
FIG. 1 is a plan view of diaphragm according to an exemplary embodiment of the present disclosure.

FIG. 1 shows an exemplary diaphragm 10. The diaphragm 10 has circular shape but it should be understood that other shapes could be used. The diaphragm 10 has an inner first portion 12, a second portion 14 and an outer flange 16. The first portion 12 is circular. The second portion 14 surrounds the first portion 12 and has an annular shape. The outer portion 16 is also annular and has an outer circumferential edge 19.

The diaphragm has a centre 11. The outer circumference of the first portion 12 defines a node 18 between the first portion 12 and the second portion 14. The outer circumference of the second portion 14 defines a node 17 between the second portion 14 and the outer flange 16. The two nodes 17, 18 are concentric about the centre 11.

The diaphragm 10 is formed of a deformable material. In this embodiment, the material is a metallic alloy such as a TZM alloy. The diaphragm therefore is electrically conductive.

The diaphragm 10 is formed with nodes 17 and 18 so that the first and second portions can deform, when subjected to pressure, independently of each other. In other words, the first portion 12 can deform (or flip) between a concave and convex configuration (and vice versa), while second portion 14 remains in the same configuration. In the same way, second portion 14 can deform between a concave and convex configuration (and vice versa), while first portion 12 remains in the same configuration.

Figure 2A:
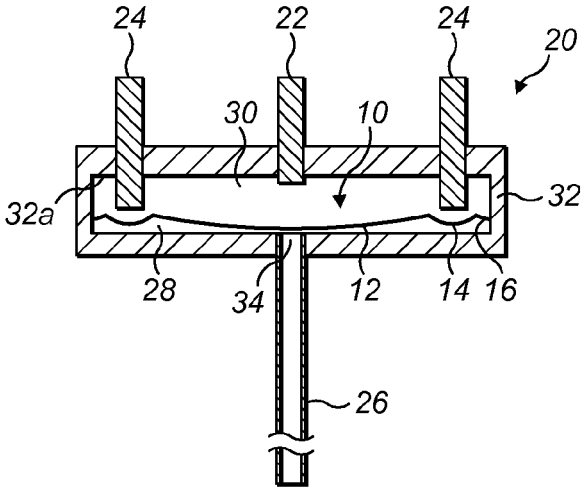
FIGS. 2*a* to 2*c* show schematic cross-sectional views of an overheat or fire alarm system according to an exemplary embodiment of the present disclosure under three different pressure conditions.

The diaphragm 10 has a three-dimensional (i.e. non-flat) shape when at rest, i.e. when subjected to low or ambient pressure (as shown in FIG. 2*a*). The diaphragm 10 is formed with such a shape by mechanically forming a blank in a press die. If required, further shaping of the diaphragm can be performed using fluid pressure. The first and second portions 12, 14 of the diaphragm 10 may be etched (using wet or dry techniques) so that they have different thicknesses. The thinner a portion of the diaphragm 10, the more easily it will deform under pressure. Making the second portion 14 thinner than the first portion 12 will mean that the second portion 14 deforms under a lower pressure than the first portion 12.

Figure 2B:
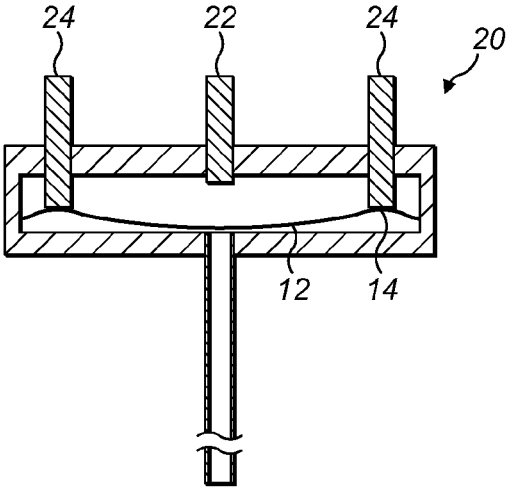
Figure 2C:
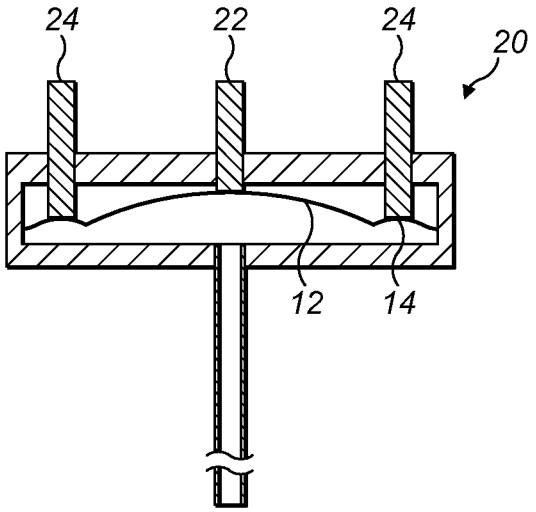

FIGS. 2*a* to 2*c* show an overheat or fire alarm system comprising a pneumatic pressure detector 20 connected to a sensor tube 26. The sensor tube 26 is shown schematically and may have a length of up to 10 meters. The sensor tube 26 comprises a stainless steel tube containing a metal hydride core (e.g. titanium hydride) and an inert gas fill (e.g. helium), as is known in the art.

Figure 3:
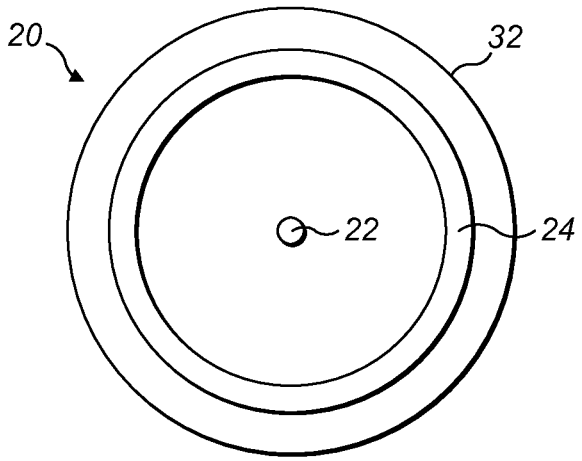
FIG. 3 shows a plan view of a pneumatic pressure detector according to an exemplary embodiment of the present disclosure.

The pneumatic pressure detector 20 comprises a housing 32 having an inner surface 32*a*. The housing 32 has a circular shape, when viewed from above (as shown in FIG. 3), but other shapes could be used. Secured to the inner surface 32*a* is a diaphragm 10 as shown in FIG. 1. The diaphragm 10 may be brazed to the inner surface 32*a*.

Extending through the housing 2 are first and second terminals 22, 24. First terminal 22 is a pin located at a centre of the housing 32. Second terminal 24 is in the form of a ring (as shown in FIG. 3) but other shapes would be possible.

The first terminal 22 is aligned with first portion 12 of diaphragm 10 and in particular with the centre 11 thereof. The second terminal 24 is aligned with annular second portion 14 of diaphragm 10.

The housing 32 is hermetically sealed around first and second terminals 22, 24. The housing 32 is electrically connected to diaphragm 10 but insulated from terminals 22, 24 via an insulating sleeve (not shown) around each terminal 22, 24.

The diaphragm 10 separates the interior of the housing into a first plenum 28 and a second plenum 30. The first and second plenums 28, 30 are hermetically isolated from each other. The first plenum 28 is in fluid communication with sensor tube 26 via gas inlet 34.

The first and second terminals 22, 24 extend into the second plenum 30. The first terminal 22 has a shorter length than the second terminal 24 such that the separation between the end of the terminal 22 and the diaphragm 10 in its at-rest position (FIG. 2*a*) is larger than the separation between the end of the terminal 24 and the diaphragm 10.

The first and second terminals 22, 24 are connected via suitable circuitry (not shown), to devices providing first and second alarms (not shown). Suitable circuitry would be apparent to the skilled person. The alarm devices may provide a visual alert, for example the turning on and off of a lamp, or an audible alert, such as the sounding of a siren. Alternatively, the alarm means may send an alarm message to a user, for example via a display unit. The first alarm may constitute a fire or overheat alarm when the first terminal is closed. The second alarm may constitute an integrity alarm when the second terminal is open.

FIG. 2*a* shows the diaphragm 10 in a first at-rest position. The diaphragm 10 remains in this first position when insufficient pressure acts upon the diaphragm 10. This may be the case when there is a leak in the sensor tube 26 or before the helium gas fill has been added. The pneumatic pressure detector is designed such that normal, ambient pressure, in the location in which the detector is to be installed, will not deform the diaphragm from this first position.

In the first position of the diaphragm 10, when viewed from below (i.e. from the position of the gas inlet 34 in the first plenum 28), the first portion 12 has a convex shape and the second portion 14 also has a convex shape. In other words, both first and second portions 12, 14 bulge into the first plenum 28. The first and second portions 12, 14 are both in a relaxed or undeformed state.

In the first position of the diaphragm 10, the first and second terminals 22, 24 are both open. In this position, the second (integrity) alarm would be activated.

As the gas pressure in the first plenum 28 increases, for instance due to the helium gas fill being added to the sensor tube 26, the diaphragm 10 moves into a second position, as shown in FIG. 2*b*. In this position, the second annular portion 14 has deformed upwardly (i.e. away from gas inlet 34 into second plenum 30). When viewed from below, the second portion 14 now has a concave shape. The first portion 12 has not substantially deformed (although some limited movement may have taken place).

The second position of the diaphragm 10, shown in FIG. 2*b*, is the normal, operating condition of the detector 20. In this position, the diaphragm 10 contacts and closes second terminal 24, while the first terminal 22 remains open. This indicates that the sensor tube 26 is attached and pressurised and there is no fire or overheat condition. In this position, the second (integrity) alarm is not activated. If the pressure were to drop, for example due to a leak in the sensor tube 26, then the second portion 14 would deform back to its previous configuration and the diaphragm 10 would return to its first position (as shown in FIG. 2*b*). The second (integrity) alarm would then be activated.

As the gas pressure in the second plenum 30 increases, for instance due to an overheat or fire condition causing the metal hydride core within the sensor tube 26 to evolve hydrogen, the diaphragm 10 moves into a third position, as shown in FIG. 2*c*. In this position, the first portion 12 has deformed upwardly (i.e. away from gas inlet 34 into second plenum 30). When viewed from below, the first portion 12 now has a concave shape. The second portion 14 remains in its deformed configuration, with the second terminal 24 closed.

The deformation of the first portion 12 causes the diaphragm 10 to contact and close first terminal 22. This will trigger the first (fire or overheat) alarm.

The diaphragm 10 is therefore formed such that the second portion 14 deforms at a lower pressure than the first portion 12. As discussed above, this can be achieved by selective shaping of the diaphragm 10 using mechanical forming, fluid pressure and/or wet or dry etching.

As the temperature of the sensor tube 26 is reduced, the pressure of the helium within the sensor tube 26 drops and hydrogen may be reabsorbed into the metal hydride core. This causes a drop in pressure in the first plenum 28 such that the diaphragm 10 moves from its third position back into its second position, i.e. the first portion 12 flips back into its undeformed or relaxed state. The first (fire or overheat) alarm will be deactivated.

FIG. 3 shows an overhead plan view of the detector 20. As shown, the housing 32 and the first terminal 22 are both circular, while the second terminal 24 is annular.

The pneumatic pressure detector 10 may be used in any location where it desired to monitor possible overheat or fire conditions. An example location is within an aircraft.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

The invention claimed is:

1. A pneumatic pressure detector comprising:

first and second electrical terminals; and a deformable diaphragm configured to deform between first, second and third positions, wherein in said first position, said first and second terminals are open, in said second position, said first terminal is open and said second terminal is closed, and in said third position, said first and second terminals are closed and wherein said pneumatic pressure detector is configured such that a first alarm is activated when said first terminal is closed and a second alarm is activated when said second terminal is opened.

2. The detector of claim 1, wherein said first alarm constitutes a fire or overheat alarm and said second alarm constitutes an integrity alarm.

3. The detector of claim 1, further comprising a housing, wherein said diaphragm is secured to said housing to define first and second plenums therein.

4. The detector of claim 3, wherein:

at a first pressure in said first plenum, said diaphragm is in said first position;

at a second pressure in said first plenum, said diaphragm is in said second position;

at a third pressure in said first plenum, said diaphragm is in said third position; and said second pressure is higher than said first pressure and lower than said third pressure.

5. The detector of claim 4, wherein said first and/or second terminal extends towards said diaphragm.

6. The detector of claim 5, wherein said first and second terminals both extend towards said diaphragm and the distance between said second terminal and said diaphragm in its first position is less than that between said first terminal and said diaphragm.

7. The detector of claim 3, wherein said housing has a gas inlet for connection to a sensor tube, said first plenum is in fluid communication with said gas inlet and said second plenum comprises said first and second terminals.

8. The detector of claim 1, wherein electrical contact between said diaphragm and said first terminal closes said first terminal and/or electrical contact between said diaphragm and said second terminal closes said second terminal.

9. The detector of claim 1, wherein said diaphragm comprises:

a first portion deformable between first and second configurations; and a second portion deformable between first and second configurations, wherein:

in said first position of said diaphragm said first portion and second portion are both in said first configurations;

in said second position of said diaphragm said first portion is in said first configuration and said second portion is in said second configuration; and in said third position said first portion and said second portion are both in said second configurations.

10. The detector of claim 9, wherein said second portion surrounds said first portion.

11. The detector of claim 9, wherein said second portion has an annular shape.

12. The detector of claim 9, wherein said first portion is circular.

13. The detector of claim 9, wherein increasing the pressure within said first plenum causes said second portion to deform between first and second configurations and then further increasing the pressure causes said first portion to deform between said first and second configurations.

14. A pneumatic pressure detector comprising:

a diaphragm for a pneumatic pressure detector, said diaphragm comprising:

a first portion deformable between first and second configurations; and a second portion deformable between first and second configurations while said first portion is in said first configuration, wherein said second portion surrounds said first portion; and a housing;

wherein the diaphragm is secured to the housing to define first and second plenums within said housing.

* * * * *